United States Patent [19]

Kelley

[11] Patent Number: 5,007,867

[45] Date of Patent: Apr. 16, 1991

[54] WEED RING FOR TROLLING MOTOR

[75] Inventor: Michael P. Kelley, Broken Arrow, Okla.

[73] Assignee: Zebco Corporation, Tulsa, Okla.

[21] Appl. No.: 352,570

[22] Filed: May 16, 1989

[51] Int. Cl.[5] ..... B63H 5/16

[52] U.S. Cl. ..... 440/71; 416/247 A; 440/73

[58] Field of Search ..... 440/71, 72, 73; 416/146 B, 247 A, 244 B

[56] References Cited

U.S. PATENT DOCUMENTS

| | | | |
|---|---|---|---|
| 2,143,693 | 1/1939 | Harris | 416/247 A |
| 3,619,083 | 11/1971 | Witte | 416/146 B |
| 4,450,670 | 5/1984 | Robinson | 416/146 B |
| 4,701,151 | 10/1987 | Uehara | 416/244 B |
| 4,722,667 | 2/1988 | Rikhy et al. | 416/146 B |
| 4,733,976 | 3/1988 | Henriksson et al. | 416/244 B |
| 4,801,244 | 1/1989 | Stahl | 416/146 B |
| 4,898,552 | 2/1990 | Cochran | 440/73 |

FOREIGN PATENT DOCUMENTS

| | | | |
|---|---|---|---|
| 749945 | 8/1933 | France | 416/146 B |
| 1038494 | 8/1966 | United Kingdom | 416/146 B |

*Primary Examiner*—Sherman Basinger
*Assistant Examiner*—Thomas J. Brahan
*Attorney, Agent, or Firm*—Wood, Phillips, Mason, Recktenwald & Vansanten

[57] ABSTRACT

An improvement is provided in a trolling motor of the type having a propeller, a housing with axially spaced leading and trailing ends, a shaft carrying a propeller and journalled for rotation in the housing, and a drive for rotating the shaft and propeller. The housing trailing end has an annular, radially inwardly facing surface and the propeller has a hub with an annular, radially outwardly facing surface on which blades are mounted. The housing, shaft and propeller are mounted relative to each other so that the radially inwardly facing housing surface is radially outside of and in axially overlapping relationship with the radially outwardly facing propeller surface.

12 Claims, 1 Drawing Sheet

FIG. 1
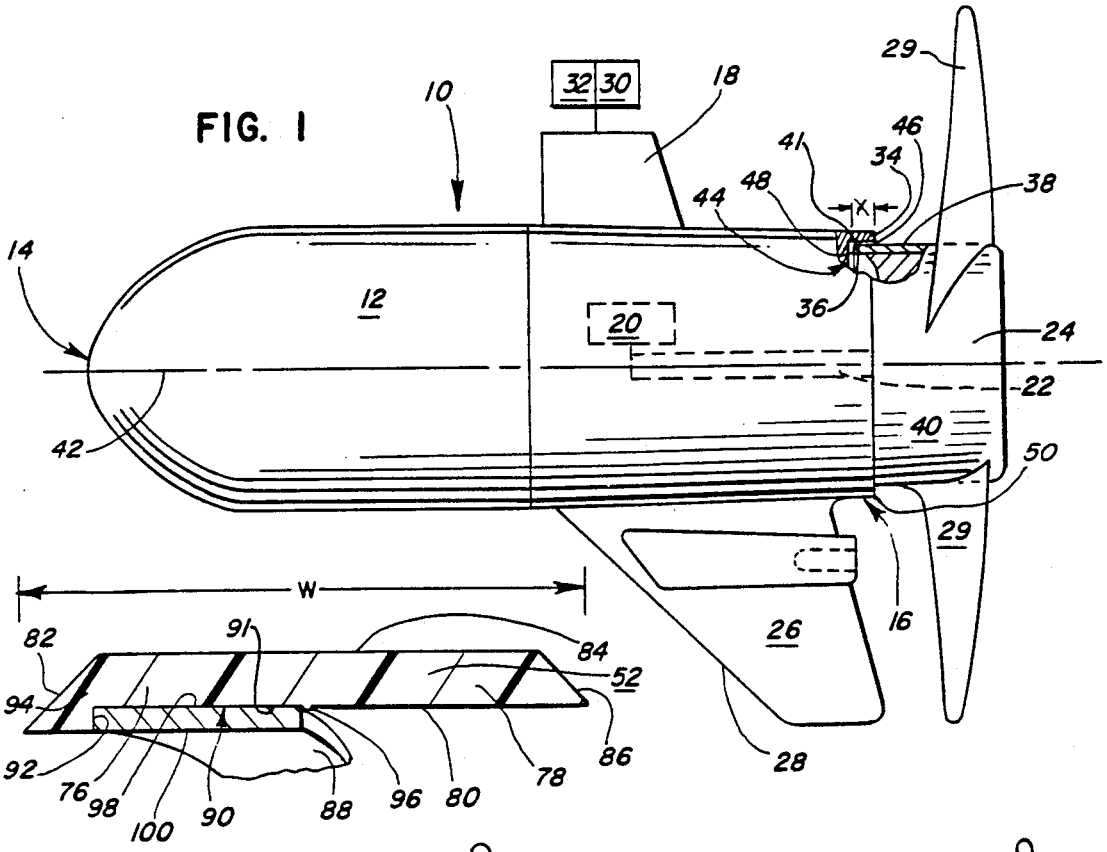
FIG. 4
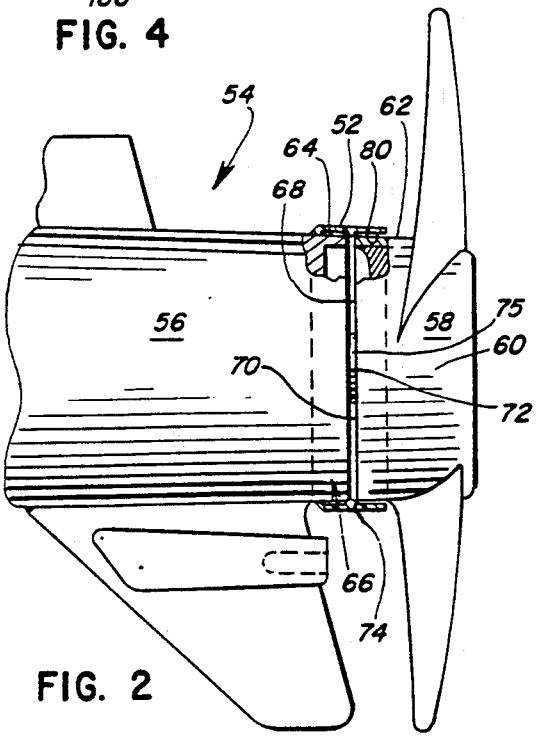
FIG. 2
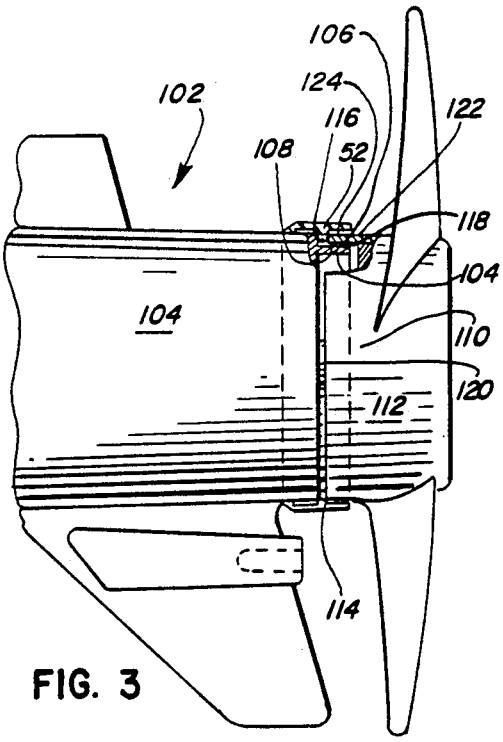
FIG. 3

WEED RING FOR TROLLING MOTOR

BACKGROUND OF THE INVENTION

1. Field of the Invention

This invention relates to trolling motors and, more particularly, to structure for preventing migration of seaweed, fishing line, and other foreign matter between a propeller and a housing relative to which the propeller is rotated during operation.

2. Background Art

Electric trolling motors are commonly employed to maneuver boats at slow speeds without generating noise that might scare away fish. Generally, a housing containing a motor is submerged in the water and carried by a vertical, elongate shaft supported from a gunwale on a boat. The motor can be operated at speeds slow enough that the boat movement is barely detectable.

One problem that is prevalent with trolling motors of the type described above is that there is a tendency of weeds, line and other foreign material to migrate between the propeller and the motor housing and wind on the shaft, with the possibility of resulting motor damage, seal damage and the like. This necessitates the user's having to tilt up the motor and unwind the foreign matter. In a worse case, disassembly of the lower unit may be required. This problem, which is particularly prevalent with trolling motors, is generally not contended with with higher speed outboard motors due to the rearward rush of water in normal operation that tends to divert foreign matter away from the juncture between the propeller and housing.

An exemplary prior art structure, wherein the above problem is contended with, is shown in U.S. Pat. No. 3,954,082, to Roller et al. In Roller et al, the motor housing has a trailing end with an outer surface that converges towards the propeller. A gap is defined between the trailing housing edge and the propeller. Seaweed passing over the housing has a tendency to travel down the converging housing surface and is effectively funnelled into the gap between the propeller and the housing whereupon it may wrap around the propeller shaft.

The present invention is specifically directed to overcoming the above enumerated problems in a novel and simple manner.

SUMMARY OF THE INVENTION

According to the invention, an improvement is provided in a trolling motor of the type having a propeller, a housing with axially spaced leading and trailing ends, a shaft carrying a propeller and journalled for rotation in the housing, and a drive for rotating the shaft and propeller. The housing trailing end has an annular, radially inwardly facing surface and the propeller has a hub with an annular, radially outwardly facing surface on which blades are mounted. The housing, shaft and propeller are mounted relative to each other so that the radially inwardly facing housing surface is radially outside of and in axially overlapping relationship with the radially outwardly facing propeller surface.

With the inventive structure it is possible to define a circuitous route for seaweed, line, etc. to travel in order to find its way radially inwardly between the propeller and housing and against the propeller shaft.

In one form of the invention, the propeller and motor housing, when viewed in cross section through a plane containing the propeller axis, cooperatively define a U-shaped space that opens axially rearwardly with respect to the propeller shaft axis. With this arrangement, foreign material must not only follow a circuitous path, but must, upon entering the space, travel forwardly in a portion of the space defined between the propeller and housing sufficiently to clear the forward axial extent of the propeller, to find its way to the propeller shaft. Even with the housing substantially stationary, the rearward water movement resulting from the rotating propeller is generally sufficient to prevent forward migration of foreign matter through the space.

In a preferred form, the radially facing propeller and housing surfaces have an axial overlap of at least $\frac{1}{4}$ inch.

While the housing portion defining the radially facing surface that cooperates with the propeller might be formed integrally with the remainder of the housing, the invention also contemplates retrofitting of conventional trolling motors to provide a structure with improved resistance to passage of foreign matter between the propeller and housing and against the propeller shaft.

In a preferred form, a flexible strip is provided for surrounding the housing to form a ring that axially overlaps the propeller to define a space in conjunction with the propeller corresponding to that described above.

To facilitate manufacture of the strip, preferably the strip is formed by extrusion. An axially facing shoulder is provided and cooperates with a bead, formed intermediate the ring width, to define a receptacle for an adhesive which is utilized to secure the strip to the motor housing.

To facilitate assembly of the strip on the housing, preferably a pressure sensitive adhesive is utilized In a preferred form, a foam material with adhesive on its opposite faces is provided in the receptacle on the strip. The bead and shoulder prevent axial shifting of the adhesive strip. A strip portion, without adhesive and extending rearwardly of the bead, defines the radially inwardly facing surface which defines the aforementioned space in cooperation with the propeller hub.

BRIEF DESCRIPTION OF THE DRAWINGS

FIG. 1 is a side elevation view of the lower unit of a trolling motor according to the present invention;

FIG. 2 is a fragmentary side elevation view of the lower unit of a prior art trolling motor retrofit with a strip according to the present invention wrapped around a housing on the motor;

FIG. 3 is a view as in FIG. 2 of another prior art trolling motor with a retrofit strip according to the present invention;

FIG. 4 is an enlarged section view of the inventive strip shown on the trolling motors in FIGS. 2 and 3.

DETAILED DESCRIPTION OF THE DRAWINGS

In FIG. 1, a preferred form of the invention is shown incorporated into the lower unit 10 of a trolling motor. The lower unit 10 consists of a bullet-shaped housing 12 with a streamlined leading end 14 and a trailing end 16. The housing 12 has a fitting 18 at its upper end for receiving a hollow column/shaft (not shown) through which control cabling is run and through which the housing 12 is manually rotated by an operator to control the direction of propulsion.

The housing 12 encases a motor, shown schematically at 20, which drives a shaft, shown schematically at 22, for rotating a propeller 24 carried on the shaft 22. A skeg 26 depends from the underside of the housing 12 and has a conventional, inclined leading edge 28, which is designed to encounter submerged obstructions and thereby cause the unit 10 to pivot upwardly so that the blades 29 on the propeller 24 are protected.

The motor 20 is driven by any conventional power source, such as a 12 volt battery, shown schematically at 30. Conventional controls, shown schematically at 32, permit speed variation and selection of direction of rotation for the propeller 24.

The trailing end 16 of the housing 12 has an integrally formed, annular skirt 34 defining a radially inwardly facing, annular surface 36. The surface 36 is dimensioned to accept a radially outwardly facing surface 38 on the propeller hub 40. The surface 36 and hub surface 38 are shown to have a constant diameter over their axial extent. There is slight, annular space 40 maintained between the surfaces 36, 38 to permit rotation of the propeller 24 relative to the housing 12 without interference therebetween.

With the region at the juncture of the propeller 24 and housing 12 viewed in cross section, through the plane containing the shaft access 42, it can be seen that the propeller 24 and housing 12 cooperatively define a U-shaped space 44, opening axially rearwardly.

For seaweed, line, etc. to wrap around the shaft 22, the foreign matter must pass through the axially opening entryway 46, at the rear of the space 44, move axially forwardly between the surfaces 36, 38 sufficiently to clear the forward edge 48 of the propeller 24, whereupon the shaft 22 is exposed to the foreign matter. Preferably, the axial overlap of the surfaces 36, 38, indicated at X in FIG. 1, is on the order of ¼ inch or more.

The propeller 24 and housing 12 cooperatively define a circuitous path which must be traversed by foreign matter before it can reach the shaft 22. Not only is the route it must travel circuitous, but the foreign matter must travel axially forwardly past the surfaces 36, 38, which motion is resisted by the water being drawn rearwardly by of the propeller in the vicinity of the trailing end 16 of the housing 12, even though the housing 12 may be substantially stationary. Resultingly, there is a tendency of foreign matter to be drawn axially rearwardly in operation so that it is deflected by a corner 50 of the housing 12 harmlessly away from the entryway 46.

Another aspect of the invention is the provision of a strip 52, as shown in FIGS. 2–4, which can be used to retrofit conventional trolling motor structures, as shown in FIGS. 2 and 3, to produce a structure that resists migration of foreign matter towards the propeller shaft 22, similarly to the structure in FIG. 1.

The strip 52 is formed from a flexible material, such as plastic or rubber and preferably flexible PVC. The strip 52 is elongate and has a width W on the order of one inch. The strip 52 is designed to be wrapped in the form of a ring around a conventional housing to provide an annular surface corresponding to the radially inwardly facing surface 36 formed in the housing 12 of the FIG. 1 embodiment.

The strip 52, in FIG. 2, is shown on one type of conventional trolling motor at 54. The trolling motor 54 has a housing 56 that is substantially the same as the housing 12 in FIG. 1. The only significant difference between the trolling motor 54 in FIG. 2 and that in FIG. 1 is the relative dimensions of the housings and propellers. The propeller 58 in FIG. 2 has a hub 60 with an outer surface 62 having a diameter substantially equal to the diameter of the outer surface 64 on the housing 56. The hub 60 and trailing end 66 of the housing 56 do not axially overlap as in the FIG. 1 embodiment. The result is that a radially opening gap 68 is created between the forwardly facing edge 70 of the propeller 58 and the rearwardly facing edge 72 of the housing 56. Matter moving along the housing outer surface 64 may hang up on the outer corner 74 of the propeller 58 and find its way through the gap 68 and against the shaft 76, upon which it may become wrapped. The result is that one must unwrap the foreign matter or in more severe cases remove the propeller 58 to gain access to the foreign matter. Damage to the unit may also result.

By applying the strip 52 at the trailing end 66 of the housing 56, the above problem can be obviated The forward portion 76 of the strip 52 is designed to be attached to the trailing end 66 of the housing 56 in such a manner that approximately the rear half 78 of the strip 52 extends across the gap 68, to shield the same, and rearwardly therefrom in axially overlapping relationship with the propeller hub 60. The radially inwardly facing strip surface 80 corresponds to the radially inwardly facing surface 36 in the FIG. 1 embodiment and achieves the same ends. The strip 52, housing 56 and propeller 58 together define a U-shaped space corresponding to the space 44 in the FIG. 1 embodiment.

To streamline the strip 52, preferably the forward portion 76 thereof has an inclined surface 82 leading into a radially outwardly facing, smooth surface 84. A like inclined surface 86 is provided at the trailing end of the strip 52. The surfaces 82, 86 are preferably at an angle of approximately 45° with the plane of the surface 80 with the strip 52 in a flattened state To facilitate attachment of the strip 52, an adhesive element 88 is utilized. A receptacle 90 is provided for the adhesive 88 to nest and is defined cooperatively by surface 88, an axially rearwardly facing shoulder 92 on a thickened portion 94 of the strip 52 and a bead 96 approximately midway between the leading and trailing ends of the strip 52. The adhesive element 88 is preferably an acrylic foam tape with adhesive on its opposite faces 98, 100. The adhesive tape 88 is press fit into the receptacle 90 and is prevented from shifting axially in either direction by the shoulder 92 and bead 96.

The strip 52 can be covered with a protective waxed paper covering (not shown) on the tape side 100. For the user to effect assembly, all that is required is that the strip 52 be cut to length, as with a scissors, the cover removed, and the strip 52 pressed against the outer surface 64 of the housing 56 to bond the surface 100 to the housing surface 64.

The strip 52 is a low cost item and assembly thereof is simple, yet the results it produces are significant in terms of preventing migration of foreign matter towards the motor shaft 72.

In FIG. 3, a further prior art trolling motor lower unit is shown at 102. The unit 102 has a housing 104 with a radially inset skirt 104 defining a radially outwardly facing surface 106 that axially overlaps a radially inwardly facing surface 108 on the hub 110 of a propeller 112.

The unit 102 has a similar problem to the unit in FIG. 2 in that material may become snagged on the corner 115 of the propeller 112 and move into a gap 116 between the propeller 112 and housing 104, whereupon it travels axially rearwardly through an annular space 118 until it is radially exposed to the motor shaft 120.

By adhesively applying the strip 52 over the housing 104, the radially inwardly facing surface 80 of the strip axially overlaps the radially outwardly facing surface 122 of the propeller 112 so as to define an annular gap 124 through which the foreign matter must travel in a forward direction in order to find its way to the shaft 120.

The foregoing disclosure of specific embodiments is intended to be illustrative of the broad concepts comprehended by the invention.

I claim:

1. An improved trolling motor of the type having a propeller with a hub having an annular wall having a leading edge, a housing with axially spaced leading and trailing ends, a shaft carrying the propeller and journalled for rotation in the housing, and means for rotatably driving the shaft and propeller, the improvement comprising:

cooperating means on the housing, shaft and propeller for mounting the propeller with respect to the housing so that there is an annular space between a stationary annular inwardly facing surface on a first wall at the trailing end of the housing and a radially outwardly facing annular surface on the annular wall of the propeller, there being an axially rearwardly opening entryway communicating between the annular space between the first wall and propeller wall and externally of said trolling motor, said cooperating means further including a second annular wall on the housing spaced radially inwardly of the stationary annular inwardly facing surface and defining in conjunction with the first wall a relatively narrow U-shaped rearwardly opening seat in which the propeller wall resides so that the outwardly facing propeller wall surface axially overlaps the first and second walls, said housing, shaft and propeller being relatively oriented so that foreign matter entering the opening between the propeller wall and stationary annular surface through said entryway must move axially forwardly through said annular space between the first wall and propeller wall beyond the leading edge of the propeller and thereafter rearwardly between the propeller wall and second wall to be radially exposed to the propeller shaft, said propeller annular wall defining the radially outermost extent of the propeller hub at the leading edge thereof.

2. The improved trolling motor according to claim 1 wherein the axial overlap of said housing wall and propeller hub is at least ¼ inch.

3. The improved trolling motor according to claim 1 wherein means separate from the housing are attached to the housing for defining the first wall with the stationary inwardly facing annular surface at the trailing end of the housing.

4. An improved trolling motor of the type having a propeller with an annular wall having a leading edge, a housing with axially spaced leading and trailing ends, a shaft carrying the propeller and journalled for rotation in this housing, and means for rotatably driving the shaft and propeller, the improvement comprising:

cooperating means on the housing, shaft and propeller for mounting the propeller with respect to the housing so that there is an annular space between a stationary annular inwardly facing surface on a first wall at the trailing end of the housing and a radially outwardly facing annular surface on the annular wall of the propeller, there being an axially rearwardly opening entryway communicating between the annular space between the first wall and propeller wall and externally of said trolling motor, said cooperating means further including a second annular wall on the housing spaced radially inwardly of the stationary annular inwardly facing surface and defining in conjunction with the first wall a relatively narrow U-shaped rearwardly opening seat in which the propeller wall resides so that the outwardly facing propeller wall surface axially overlaps the first and second walls, said housing, shaft and propeller being relatively oriented so that foreign matter entering the opening between the propeller wall and stationary annular surface through said entryway must move axially forwardly through said annular space between the first wall and propeller wall beyond the leading edge of the propeller and thereafter rearwardly between the propeller wall and second wall to be radially exposed to the propeller shaft, wherein means separate from the housing are attached to the housing for defining the first wall with the stationary inwardly facing annular surface at the trailing end of the housing, wherein the means defining the stationary annular surface comprises a flexible strip secured by adhesive to the housing.

5. The improved trolling motor according to claim 4 wherein said flexible strip is formed by extrusion.

6. The improved trolling motor according to claim 4 wherein said strip is made from plastic.

7. An improved trolling motor of the type having a propeller, a housing with axially spaced leading and trailing ends, a shaft carrying the propeller are journalled for rotation in the housing, and means for rotatably driving the shaft and propeller, the improvement comprising:

cooperating means on the housing, shaft and propeller for mounting the propeller with respect to the housing so that there is an annular space between a stationary annular surface at the trailing end of the housing and a surface of the propeller and an axially opening entryway of said trolling motor, said housing, shaft and propeller relatively oriented so that foreign matter entering the opening between the propeller and stationary annular surface through said entryway must move axially forwardly through said annular space beyond the leading edge of the propeller to be radially exposed to the propeller shaft, wherein means separate from the housing are attached to the housing for defining the stationary annular surface at the trailing end of the housing, wherein the means defining the stationary annular surface comprises a flexible strip secured by adhesive to the housing, wherein said strip has an elongate configuration and a width, there is an axially facing shoulder and a bead extending lengthwise of the strip with the shoulder and bead cooperatively defining a receptacle for the adhesive that secures the strip to the housing.

8. The improved trolling motor according to claim 7 wherein said strip has a front and rear edge, the strip receptacle resides in axial coincidence with the housing and the rear edge axially overlaps the propeller.

9. The improved trolling motor according to claim 7 wherein the bead is located between the front and rear edges and there is a radially inwardly facing surface rearwardly of said bead that overlies the propeller.

10. The improved trolling motor according to claim 9 wherein the propeller has a forward edge, the housing has a rearward edge, there is a gap between the forward edge of the propeller and the rearward edge of the housing and the radially inwardly facing strip surface radially overlies and extends axially rearwardly of said gap.

11. The improved trolling motor according to claim 10 wherein said adhesive comprises a foam tape with opposite faces and pressure sensitive adhesive on the opposite faces of the tape for adherence of the strip to the housing.

12. An improved trolling motor of the type having a propeller, a housing with axially spaced leading and trailing ends, a shaft carrying the propeller and journalled for rotation in the housing, and means for rotatably driving the shaft and propeller, the improvement comprising:

said housing trailing end having an outer, radially outwardly facing surface and an annular radially inwardly facing surface;

said propeller having a hub with an annular radially outwardly facing outer surface to which a plurality of blades are attached; and cooperating means on the housing, shaft and propeller for mounting the propeller with respect to the housing so that the radially inwardly facing housing surface is radially outside of, in axially overlapping relationship with, and in close proximity to, the outwardly facing propeller surface, wherein the cooperating means includes a strip attached to the housing outer surface defining said radially inwardly facing housing surface, wherein at least portions of the outer surfaces of the housing trailing end and propeller housing are spaced from each other in an axial direction to define a radially opening space and the strip overlaps the radially opening space so that the radially opening space is completely blocked in a radial direction by said strip over substantially the entire circumferential extend of the radially opening space.

* * * * *